US010639520B2

(12) United States Patent
Hou et al.

(10) Patent No.: US 10,639,520 B2
(45) Date of Patent: May 5, 2020

(54) MAGNETIC CONTROL WATER RESISTANCE ROWING MACHINE

(71) Applicant: Yanwei Hou, Xiamen, Fujian (CN)

(72) Inventors: Yanwei Hou, Xiamen (CN); Yu Sun, Xiamen (CN)

(73) Assignee: Amoy YG Sports Technology Co., Ltd., Xiamen (CN)

( * ) Notice: Subject to any disclaimer, the term of this patent is extended or adjusted under 35 U.S.C. 154(b) by 113 days.

(21) Appl. No.: 15/934,420

(22) Filed: Mar. 23, 2018

(65) Prior Publication Data

US 2018/0272182 A1 Sep. 27, 2018

(30) Foreign Application Priority Data

Mar. 24, 2017 (CN) ..... 2017 2 0295690 U

(51) Int. Cl.
*A63B 22/00* (2006.01)
*A63B 21/00* (2006.01)
(Continued)

(52) U.S. Cl.
CPC ..... *A63B 22/0076* (2013.01); *A63B 21/0051* (2013.01); *A63B 21/0084* (2013.01);
(Continued)

(58) Field of Classification Search
CPC ..... A63B 22/0076; A63B 21/00192; A63B 2209/08; A63B 22/0087; A63B 21/0084; A63B 21/0051; A63B 2022/0035; A63B 23/0233; A63B 23/0211; A63B 21/153; A63B 21/023; A63B 22/0089; A63B 2022/0079–0084; A63B 2022/0092–0097
See application file for complete search history.

(56) References Cited

U.S. PATENT DOCUMENTS 4,846,460 A * 7/1989 Duke ..... A63B 21/153 482/73
4,884,800 A * 12/1989 Duke ..... A63B 21/154 482/73
(Continued)

FOREIGN PATENT DOCUMENTS

CN 304082437 S 3/2017
WO WO-2017133048 A1 * 8/2017 ..... A63B 21/005

*Primary Examiner* — Andrews S Lo
(74) *Attorney, Agent, or Firm* — Cooper Legal Group, LLC

(57) ABSTRACT

A magnetic control water resistance rowing machine has a main rack, a ribbon, a ribbon recycling plate set, an aluminum wheel water resistance device set, a magnetic plate set and a seat cushion. The ribbon is connected with a ribbon recycling plate. The ribbon recycling plate set is mounted on the main rack by a torsion spring to recycle the ribbon when the ribbon is loosened; the aluminum wheel water resistance device set is mounted on the main rack and the aluminum wheel water resistance device set cooperates with the ribbon recycling plate set. The ribbon recycling plate set is connected to the aluminum wheel water resistance set drive; the magnetic plate is mounted on the main rack. The magnetic plate cooperates with the aluminum wheel water resistance. The main rack has a slide rail engagement and the seat cushion is slidably engaged with the slide rail engagement.

18 Claims, 10 Drawing Sheets

(51) Int. Cl.
*A63B 21/005* (2006.01)
*A63B 21/008* (2006.01)
*A63B 23/02* (2006.01)
*A63B 21/02* (2006.01)

(52) U.S. Cl.
CPC .... *A63B 21/00192* (2013.01); *A63B 22/0087* (2013.01); *A63B 21/023* (2013.01); *A63B 21/153* (2013.01); *A63B 23/0211* (2013.01); *A63B 23/0233* (2013.01); *A63B 2022/0035* (2013.01); *A63B 2022/0079* (2013.01); *A63B 2209/08* (2013.01)

(56) References Cited

U.S. PATENT DOCUMENTS 4,940,227 A * 7/1990 Coffey ..... A63B 22/0076 482/73
5,072,929 A * 12/1991 Peterson ..... A63B 22/0076 310/105
5,104,363 A * 4/1992 Shi ..... A63B 22/001 482/131
5,110,118 A * 5/1992 Winey ..... A63B 21/023 482/113
5,470,295 A * 11/1995 Wang ..... A63B 21/068 482/71
5,707,322 A * 1/1998 Dreissigacker ..... A63B 21/227 482/72
7,572,211 B2 * 8/2009 Roach ..... A63B 22/0076 482/51
2005/0101450 A1 * 5/2005 Gramaccioni ..... A63B 21/225 482/72
2010/0190615 A1 * 7/2010 Baker ..... A63B 22/0076 482/73
2011/0028278 A1 * 2/2011 Roach ..... A63B 22/0076 482/72
2013/0225374 A1 * 8/2013 Lumsden ..... A63B 22/0076 482/72
2013/0225375 A1 * 8/2013 Lumsden ..... A63B 22/0076 482/72
2015/0202484 A1 * 7/2015 Lalaoua ..... A63B 21/025 482/127
2016/0107023 A1 * 4/2016 Campanaro ..... A63B 22/0087 482/72
2016/0144223 A1 * 5/2016 Dalebout ..... A63B 22/0076 482/72
2018/0001133 A1 * 1/2018 Campanaro ..... A63B 22/0087
2018/0056118 A1 * 3/2018 Bates ..... A63B 21/4035
2018/0099178 A1 * 4/2018 Schaefer ..... A63B 21/023 482/113
2018/0126216 A1 * 5/2018 Hamilton ..... A63B 22/0076 310/105

* cited by examiner

MAGNETIC CONTROL WATER RESISTANCE ROWING MACHINE

FIELD OF INVENTION

The present invention relates to a fitness device, and more particularly, to a magnetic control water resistance rowing machine capable of simulating the boating movement

BACKGROUND OF INVENTION

The rowing machine is also called the rowing boat, is a kind of fitness equipment to simulate the boating movement, has a better effect on the leg, waist, upper limbs, chest, back muscles. A conventional rowing boat (as disclosed in bulletin No. CN304082437S) adopts a water damper as a damping wheel, wherein a handle is usually connected with a ribbon, a ribbon is connected to a pulley, a pulley is connected to a water resistance device. When the damping size needs to be adjusted, it is achieved by adjusting the level of the water level of the water resistance device or by adjusting the external friction mechanism to adjust the damping size, thus bringing about the drawback of inconvenience. On the other hand, the prior art of such a rowing boat usually adopts elastic rope to achieve the ribbon recycling, resulting in the drawback of a more complex structure.

SUMMARY OF THE INVENTION

In order to solve the technical problems existing in the prior art, the present invention provides a magnetic control water resistance rowing machine which has a simple structure by improving the magnetoresistive structure on the basis of the water resistance device and improving the structure of the ribbon recycling. The production cost is low, the damping adjustment is convenient.

The technical solution adopted by the invention to solve the above technical problem is that, The invention provides a magnetic control water resistance rowing machine which comprises a main rack, a ribbon, a ribbon recycling plate set, an aluminum wheel water resistor set, a magnetic plate set and a seat cushion; the ribbon is connected with the ribbon recycling plate set, and the ribbon recycling plate set is mounted on the main rack by means of a torsion spring in order to recycle the ribbon when the ribbon is loosened; the aluminum wheel water resistor set is mounted on the main rack and is in a position where the aluminum wheel water resistor set cooperates with the ribbon recycling plate set, and the ribbon recycling plate set is drivably connected to the aluminum wheel water resistor set; the magnetic plate set is mounted on the main rack and is in a position where the magnetic plate cooperates with the aluminum wheel water resistor set, to achieve the adjustment of the damping size of the aluminum wheel water resistor set; the main rack has a slide rail engagement, and the seat cushion is slidably engaged with the slide rail engagement.

As a preferred embodiment of the present invention, said aluminum wheel water resistor set comprises an aluminum wheel set and a water resistance device; said ribbon recycling plate set is connected to the aluminum wheel set drive of the aluminum wheel water resistor set, said aluminum wheel set is connected to the water resistance device drive; said magnetic plate set is mounted in a position where the magnetic plate set cooperates with the aluminum wheel set to achieve the adjustment of the damping size.

As a preferred embodiment of the present invention, said ribbon recycling plate set has a first belt turntable, said aluminum wheel set has a second belt turntable, a belt is connected between the first belt turntable of the ribbon recycling plate set and the second belt turntable of the aluminum wheel set to make the ribbon recycling plate set to drive the rotation of the aluminum wheel set through the belt.

As a preferred embodiment of the present invention, said ribbon recycling plate set has a first sprocket wheel, said aluminum wheel set has a second sprocket wheel, a chain is connected between the first sprocket wheel of the ribbon recycling plate set and the second sprocket wheel of the aluminum wheel set to make the ribbon recycling plate set to drive the rotation of the aluminum wheel set through the chain.

As a preferred embodiment of the present invention, said ribbon recycling plate set is rotatably mounted on the main rack by a first wheel shaft.

As a preferred embodiment of the present invention, said aluminum wheel set further comprises an aluminum wheel and a second wheel shaft, said second belt turntable or said second sprocket wheel is fixed to the second wheel shaft, and the aluminum wheel is also fixed on the second wheel shaft, both ends of the second wheel shaft are rotatably mounted on the main rack by flange set, respectively.

As a preferred embodiment of the present invention, said first and second wheel shaft are respectively disposed along the length of the magnetic control water resistance rowing machine and the position of the second wheel shaft is higher than the position of the first wheel shafts As a preferred embodiment of the present invention, said water resistance device has a built-in third wheel shaft, and the third wheel shaft of said water resistance device is connected to the second wheel shaft of said aluminum wheel set by a rotary engagement, so that the rotation of the second wheel shaft of the aluminum wheel set can drive the built-in third wheel shaft of the water resistance device to rotate. As a preferred embodiment of the present invention, said water resistance device is mounted on the main rack in an oblique manner.

As a preferred embodiment of the present invention, said magnetic plate set comprises a pallet having a U-shaped cross section and a magnet mounted in the pallet by a positioning grid, said U-shaped opening of the pallet is adapted to the edge of the aluminum wheel; and the end of the pallet is rotatably mounted on the main rack, and the pallet is also connected with a spinner or a servomotor by a cable.

As a preferred embodiment of the present invention, said main rack further comprises a front bottom pipe engagement, a rear bottom pipe engagement and a frame engagement; said frame engagement is connected to a front end of a slide rail engagement, and the front bottom pipe engagement is fixed to the bottom of the frame engagement, and the rear bottom engagement is fixed to the rear end of the slide rail engagement; the frame engagement is in an inclined shape.

As a preferred embodiment of the present invention, said seat cushion comprises a seat plate, a chute provided at the bottom of the seat plate and a backrest which is hingedly connected to the rear end of the seat plate; the chute of the seat cushion is slidably engaged with the slide rail engagement As a preferred embodiment of the present invention, a connecting member is further provided between said seat plate and said chute, said backrest comprises a backrest bar and a plurality of cross bars, the bottom end of the said backrest is hinged at the rear end of the connecting member by a torsion spring, the plurality of cross bars are fixed on both sides of the backrest bar respectively; and the plurality of cross bars cover cylindrical drums respectively According to the above-mentioned technical proposal, the advantageous effect obtained by the present invention is that, (1) Since the ribbon recycling plate set is used as the ribbon recycling machine, the ribbon recycling plate set is mounted on the main rack by the torsion spring, so that the ribbon recycling plate set can recycle the ribbon when the ribbon is loosened. The structure of the present invention can realize the rapid recycling of the ribbon and has the characteristics of simple structure and low production cost.

(2) Due to the use of aluminum wheel set of aluminum wheel water resistor set and the magnetic plate set as a damping adjustment structure, the magnetic control water resistance rowing machine has damping adjustment convenient features.

(3) As a result of the use of the water resistance device installed on the main rack, on the one hand, you can make the product more beautiful, on the other hand, compared with the traditional horizontal water resistance, the vertical placement of the water resistance has larger storage capacity and better damping effect.

(4) As a backrest is added to the rear of the seat cushion, the backrest is hinged at the rear end of the seat plate by a torsion spring so that the back of the simulators of rowing can be supported during the simulation of rowing, greatly improve the use effect of simulation of rowing. And then a number of cross bars are set with a cylindrical drum. In the course of the use, the cylindrical drum can roll, a effect of massage on the back of a simulators of rowing is formed, increasing health effects of the product.

DETAILED DESCRIPTION OF THE PREFERRED EMBODIMENTS

Figure 1:
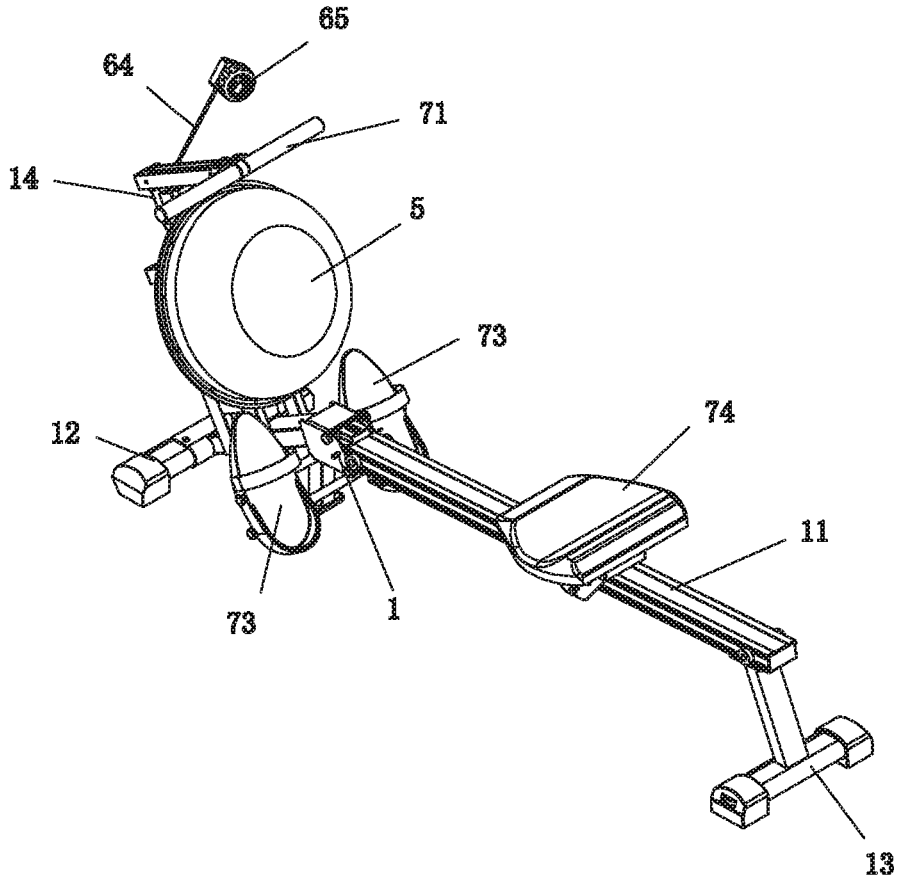
FIG. 1 is a schematic view of a three-dimensional structure of the first embodiment of the present invention.
Figure 2:
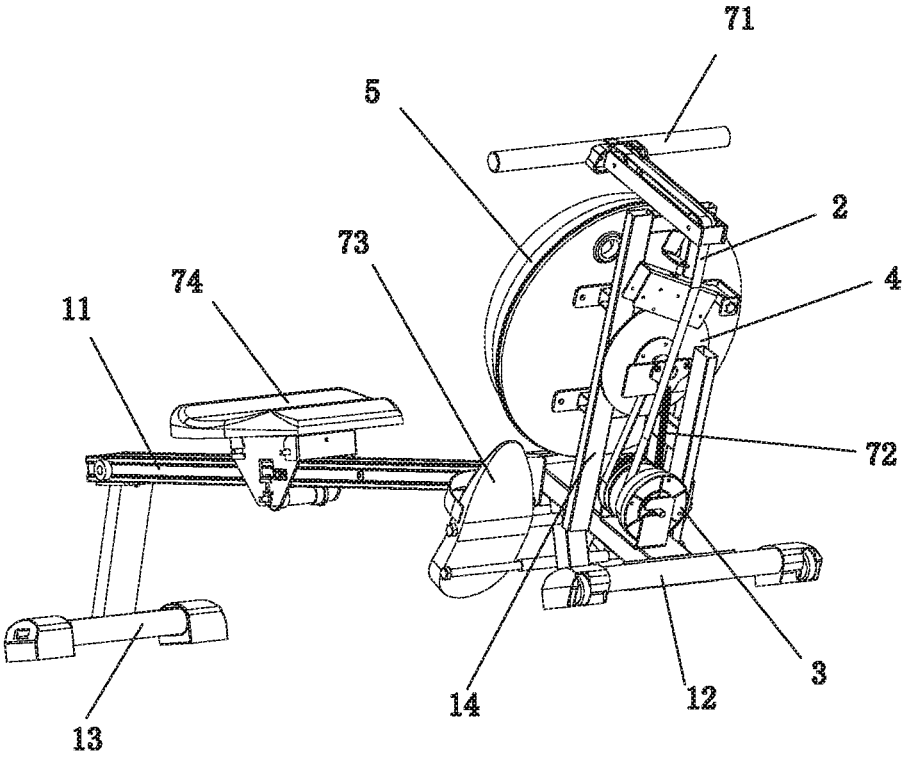
FIG. 2 is a schematic view of a three-dimensional configuration (rotation of one direction) according to the first embodiment of the present invention.
Figure 3:
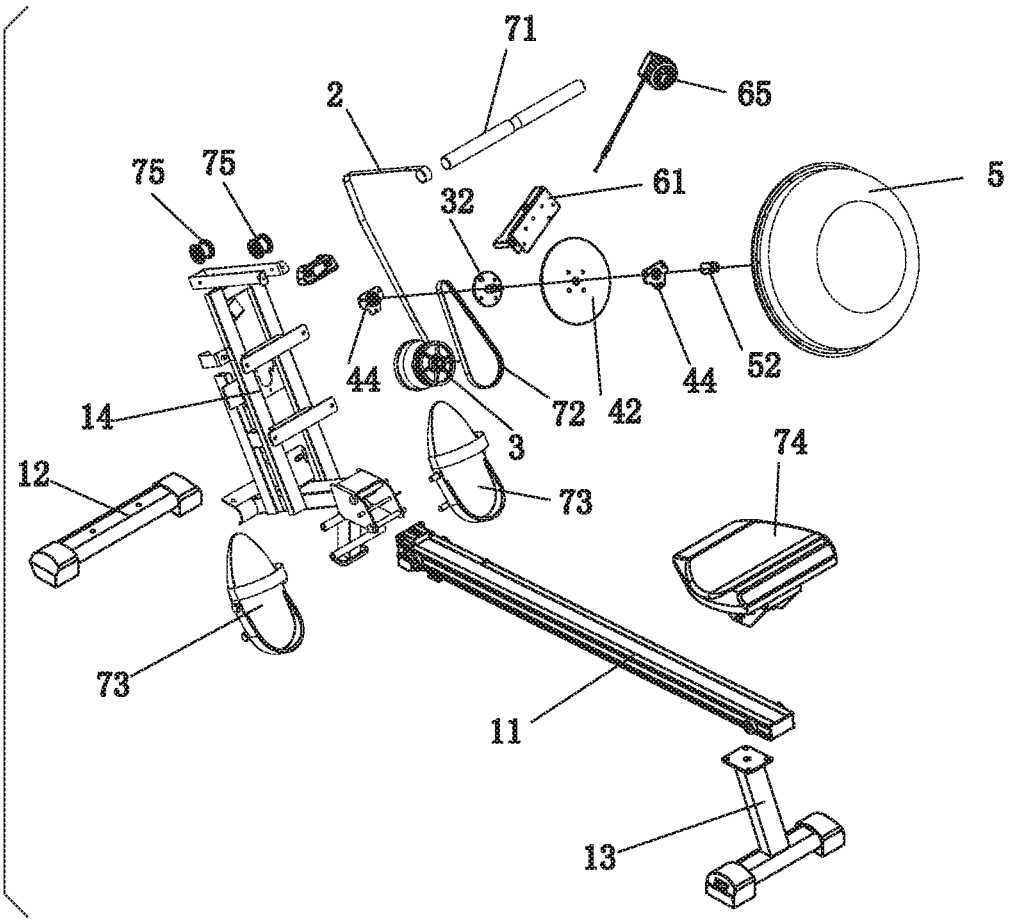
FIG. 3 is a schematic cross-sectional view of the first embodiment of the present invention.
Figure 4:
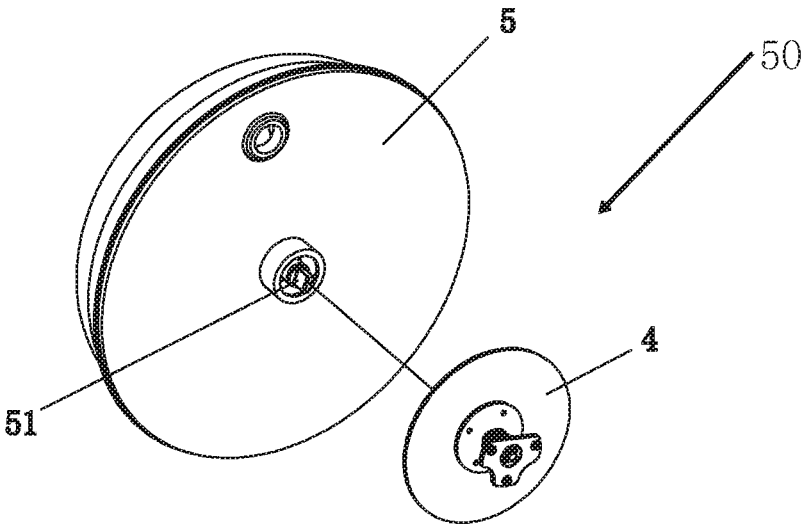
FIG. 4 is a schematic view of a set of aluminum wheel water resistor set according to the first embodiment of the present invention.
Figure 5:
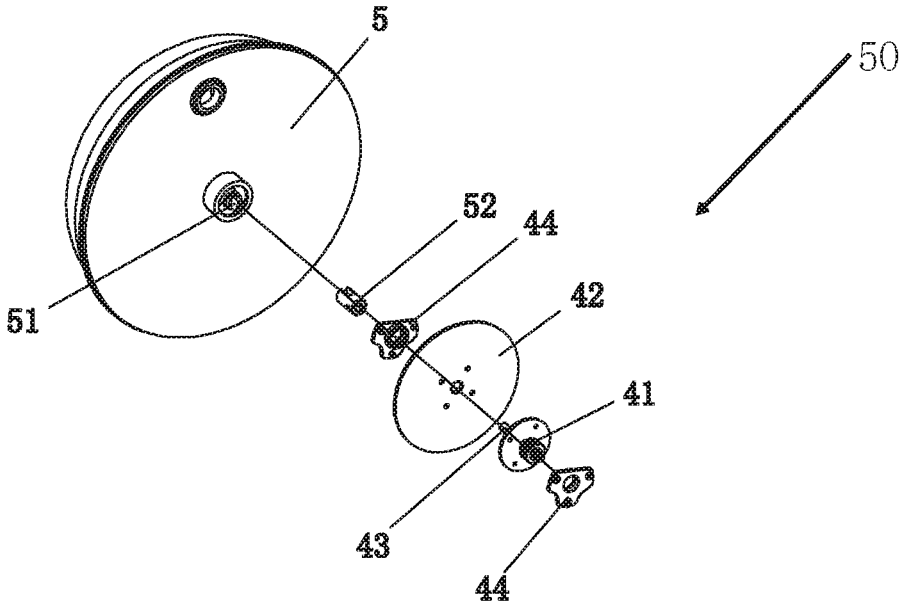
FIG. 5 is a schematic exploded view of a aluminum wheel water resistor set according to the first embodiment of the present invention.
Figure 6:
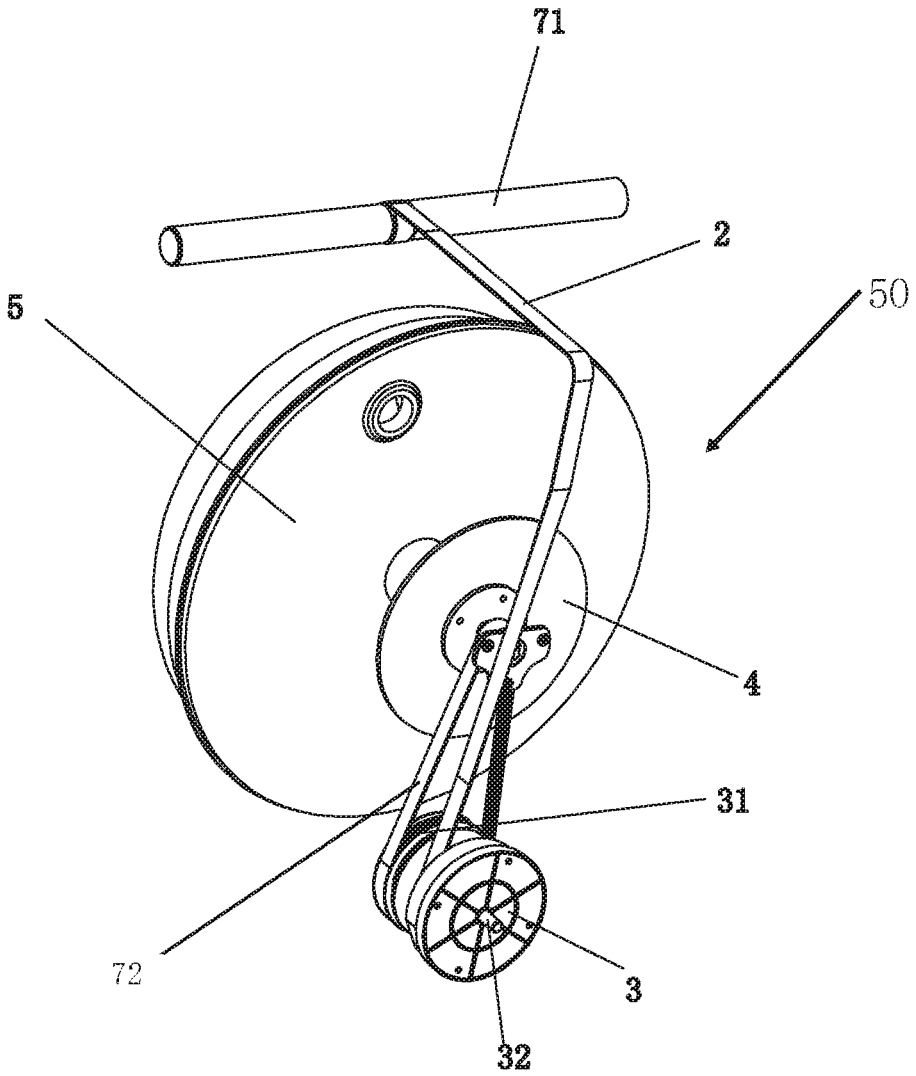
FIG. 6 is a schematic view of a set of a ribbon, ribbon recycling plate set and a aluminum wheel water resistor set according to the first embodiment of the present invention.
Figure 7:
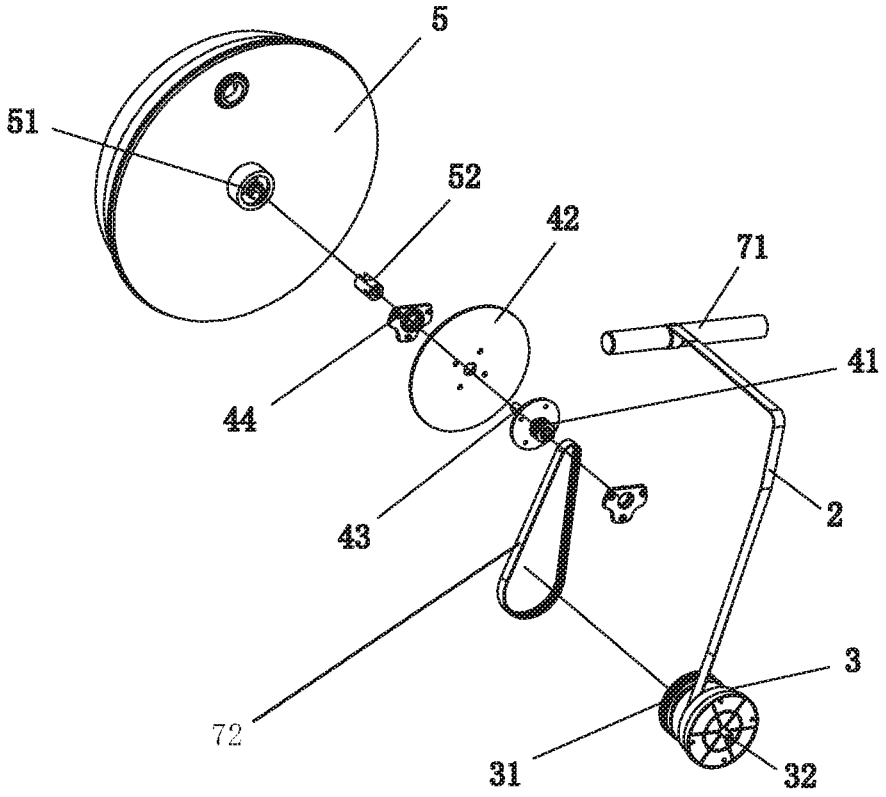
FIG. 7 is an exploded schematic view of a ribbon, ribbon recycling plate set and aluminum wheel water resistor set according to the first embodiment of the present invention.
Figure 8:
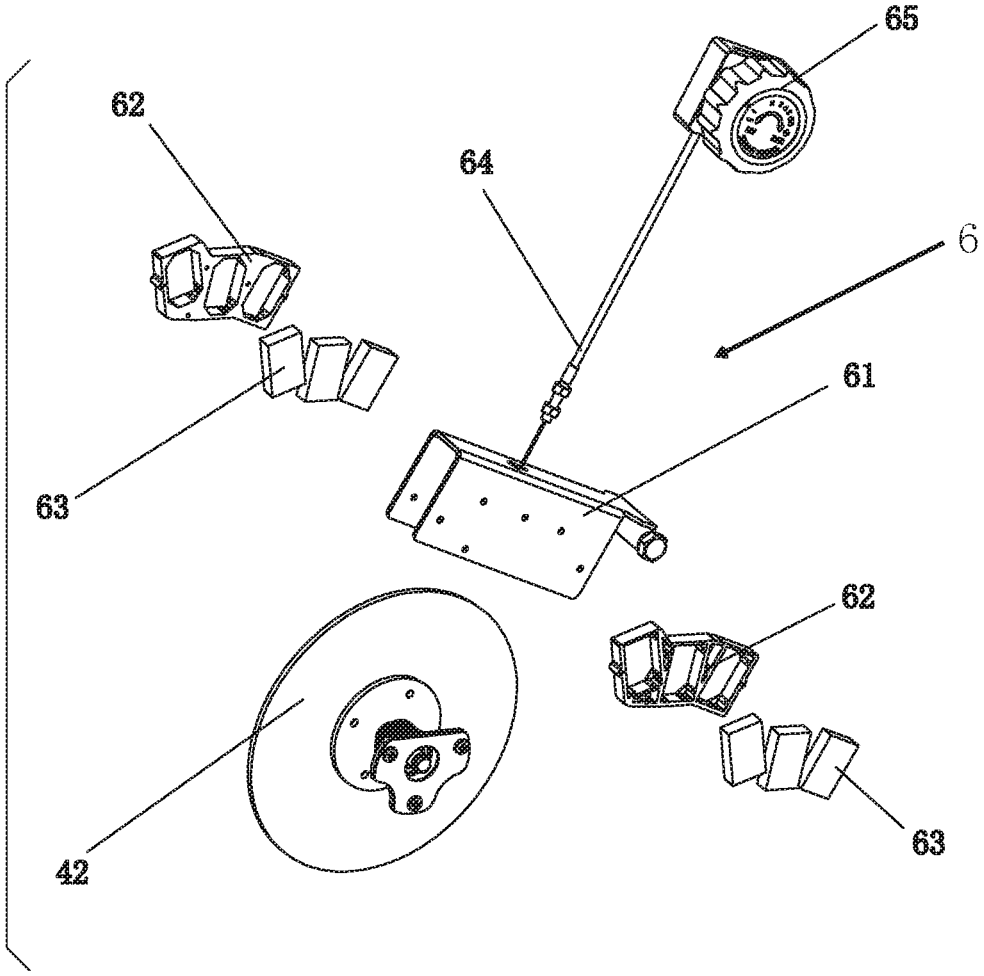
FIG. 8 is a schematic view of a set of an aluminum wheel set and a magnetic plate set according to the first embodiment of the present invention.

The technical solutions of the present invention will be described in detail with reference to the accompanying drawings and embodiments.

Embodiment 1

Referring to FIGS. 1 to 8, a magnetic control water resistance rowing machine according to the present invention comprises a main rack 1, a ribbon 2, a ribbon recycling plate set 3, an aluminum wheel water resistor set 50, a magnetic plate set 6 and a seat cushion 74; one end of the ribbon 2 is connected to the handle 71, and the other end of the ribbon 2 is connected to the ribbon recycling plate set 3, which is mounted on the main rack 1 by a torsion spring in order to recycle the ribbon 2 when the ribbon 2 is loosened; said aluminum wheel water resistor set 50 comprises an aluminum wheel set 4 and a water resistance device 5; the aluminum wheel set 4 is mounted on the main rack 1 and is in a position where the aluminum wheel set 4 cooperates with the ribbon recycling plate set 3; and the ribbon recycling plate set 3 is drivably connected to the aluminum wheel set; the water resistance device 5 is mounted on the main rack 1 and is in a position where the water resistance device 5 cooperates with the aluminum wheel set 4 so that the aluminum wheel set 4 is associated with the water resistance device 5; the magnetic plate set 6 is mounted on the main rack 1 and is in a position where the magnetic plate set 6 cooperates with the aluminum wheel set 4 to achieve the adjustment of the damping size of the aluminum wheel water resistor set 50; the main rack 1 has a slide rail engagement 11, the seat cushion 74 is slidably fitted on the slide rail engagement 11.

In the present embodiment, the ribbon recycling plate set 3 has a first belt turntable 31, the aluminum wheel set 4 has a second belt turntable 41, a belt 72 is connected between the first belt turntable 31 of the ribbon recycling plate set 3 and the second belt turntable 41 of the aluminum wheel set 4, to make the ribbon recycling plate set 3 to rotate the aluminum wheel set 4 by the belt 72.

Of course, it is also possible to use a chain drive, in which case said ribbon recycling plate set has a first sprocket wheel, said aluminum wheel set has a second sprocket wheel, a chain is connected between the first sprocket wheel of the ribbon recycling plate set and the second sprocket wheel of the aluminum wheel set to make the ribbon recycling plate set to drive the rotation of the aluminum wheel set through the chain.

In the present embodiment, the ribbon recycling plate set 3 is rotatably mounted on the main rack 1 by a first wheel shaft 32.

In the present embodiment, the aluminum wheel set 4 further comprises an aluminum wheel 42 and a second wheel shaft 43, said second sprocket disk 41 is fixed to the second wheel shaft 43, and the aluminum wheel 42 is also fixed on the second wheel shaft 43, both ends of the second wheel shaft 43 are rotatably mounted on the main rack 1 by flange set 44 respectively.

In the present embodiment, the first wheel shaft 32 and the second wheel shaft 43 are respectively provided along the length of the magnetic control water resistance rowing machine, and the position of the second wheel shaft 43 is higher than the position of the first wheel shaft 32.

In the present embodiment, the water resistance device 5 has a built-in third wheel shaft 51, and the third wheel shaft 51 of the water resistance device is coaxially connected to the second wheel shaft 43 of the aluminum wheel by a rotary engagement 52, so that the rotation of the second wheel shaft 43 of the aluminum wheel set can drive the built-in third wheel shaft 51 of the water resistance device to rotate.

In the present embodiment, the water resistance device 5 is mounted on the main rack 1 in an oblique manner.

In the present embodiment, the magnetic plate set 6 includes a pallet 61 having a U-shaped cross section and a magnet 63 mounted in the pallet by a positioning grid 62, the U-shaped opening of the pallet 61 is adapted to the edge of the aluminum wheel 42, one end of the pallet 61 is rotatably mounted on the main rack 1; and the pallet 61 is also connected to the spinner 65 by means of a wire 64. The mating position of the magnetic plate set 6 and the aluminum wheel 42 can be manually controlled by the spinner 65, to achieve the adjustment the size of the damping. Of course, the pallet can also be connected to the servo motor by cable to achieve electronic control.

In the present embodiment, the main rack 1 further includes a front bottom pipe engagement 12, a rear bottom pipe engagement 13 and a frame engagement 14, and the frame engagement 14 is connected to the front end of the slide rail engagement 11, The bottom of the frame engagement 14 is fixed to the rear end of the slide rail engagement 11, and the frame engagement 14 is in inclined shape.

The magnetic control water resistance rowing machine also includes a foot pedal 73, the slide rail engagement 11 is disposed obliquely, the foot pedal 73 is secured to the frame engagement 14, which is slidably connected to the slide rail engagement 11; the frame engagement 14 is provided with a pulley 75 for engaging the ribbon 2; the ribbon recycling plate set 3, the aluminum wheel set 4, the water resistance device 5 and the magnetic plate 6 are mounted on the frame engagement 14, respectively.

When used, the ribbon 2 is tightened, the ribbon 2 is stretched, the ribbon 2 drives the ribbon recycling plate set 3 to rotate, the torsion spring is tightened, the ribbon recycling plate set 3 is rotated to drive the aluminum wheel set 4 to rotate, the aluminum wheel set 4 rotate to drive the impeller inside the water resistance device 5 to rotate, by adjusting the magnetic plate 6, the damping size is been adjusted. When the ribbon is loosened, the torsion spring is reset, and the ribbon recycling plate set 3 reverses and the ribbon 2 is recycled.

In the magnetic control water resistance rowing machine according to the present invention, the ribbon recycling plate set 3 is used as the ribbon recycle machine, and the ribbon recycling plate set 3 is mounted on the main rack 1 by a torsion spring so that the ribbon recycling plate set 3 can be realized ribbon recycling when the ribbon is relaxed. The structure of the present invention can realize the rapid recycling of the ribbon and has the characteristics of simple structure and low production cost. The invention adopts the aluminum wheel set 4 and the magnetic plate set 6 as the damping adjustment structure, and has the characteristics of convenient damping adjustment. In the invention, the water resistance device 5 is mounted on the main rack 1 in a oblique manner, on the one hand, the product can be made more beautiful, on the other hand, compared with traditional horizontal water resistance device, the water resistance device placed vertically has larger, storage capacity and better damping effect.

Embodiment 2

Figure 9:
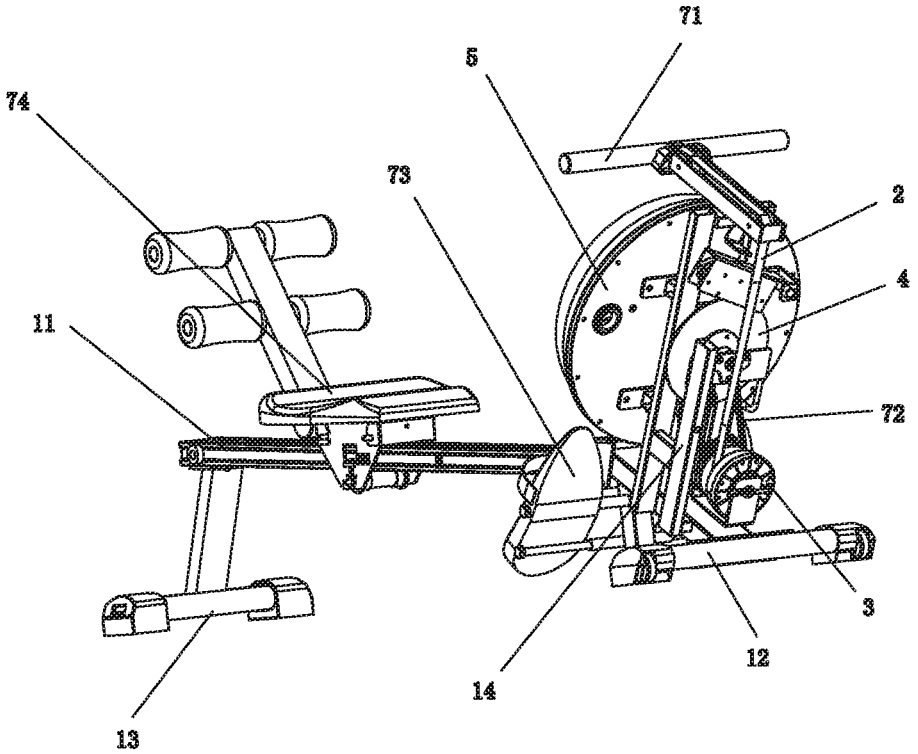
FIG. 9 is a schematic perspective view of the second embodiment of the present invention.
Figure 10:
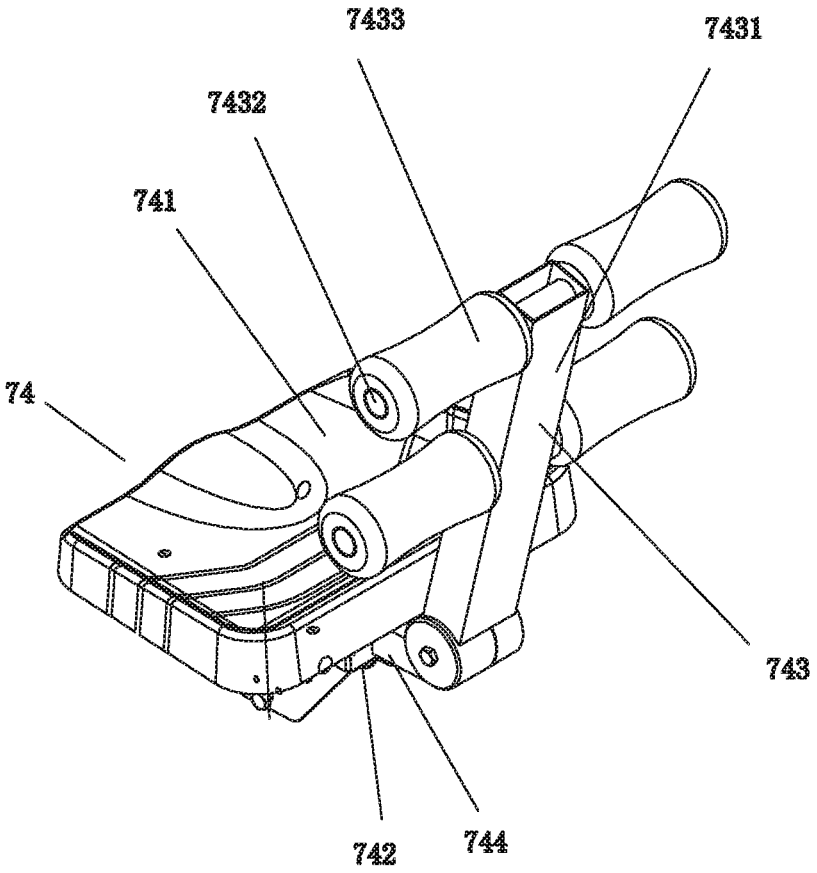
FIG. 10 is a schematic perspective view of a three-dimensional structure of a seat cushion according to the second embodiment of the present invention.
Figure 11:
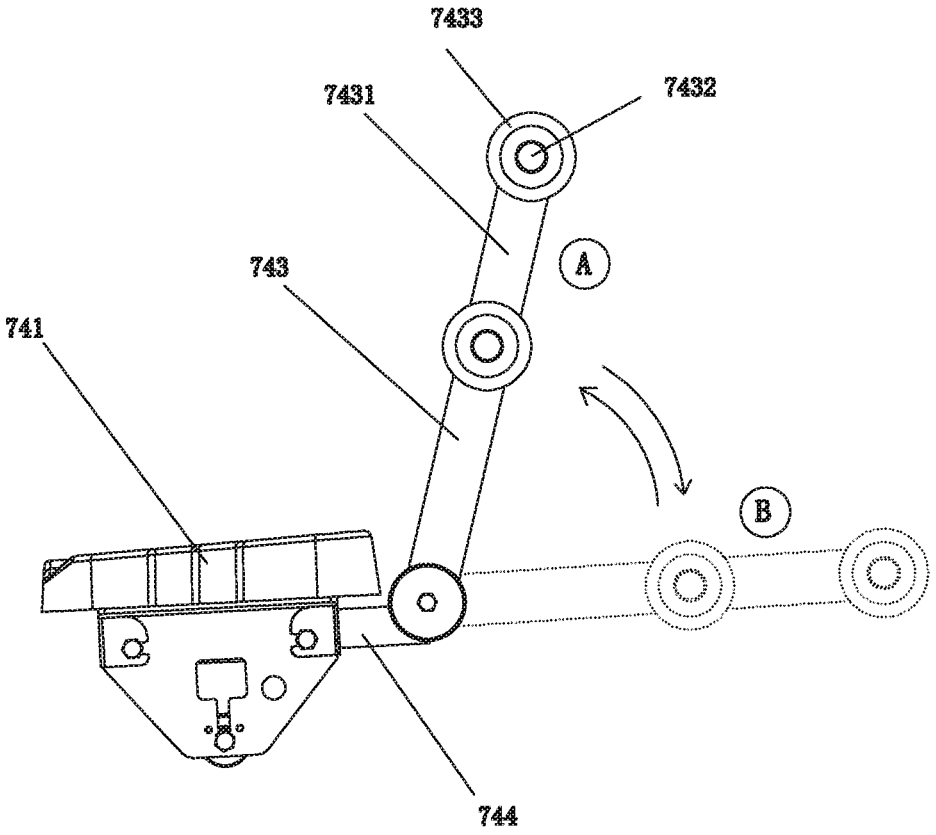
FIG. 11 is a schematic view of showing the effect of the use of the seat cushion according to the second embodiment of the present invention.

Referring to FIGS. 9 to 11, a magnetic control water resistance rowing machine according to the present invention differs from Embodiment 1 in that the seat cushion has a different structure. The seat cushion 74 of the present embodiment includes a seat plate 741, a chute 742 provided at the bottom of the seat plate and a backrest 743, the backrest 743 is hinged to the rear end of the seat plate 741 by a torsion spring. Wherein the chute 742 is fitted to the slide rail engagement 11 of the main rack 1.

Between the seat plate 741 and the chute 742 is also provided a connecting member 744, the backrest 743 is hingedly connected to the rear end of the connecting member 744 by a torsion spring. The backrest 743 includes a backrest lever 7431 and a plurality of cross bars 7432, the bottom end of a backrest lever 7431 is hinged at the rear end of the connecting member 744 by a torsion spring, and a plurality of cross bars 7432 are fixed to both sides of the backrest lever 7431, respectively. The number of the plurality of cross bars 7432 is a double number, and the plurality of cross bars 7432 are symmetrically fixed to both sides of the backrest lever 7431 in two groups. The backrest lever 7431 is a rectangular hollow tube, and the plurality of cross bars 7432 are symmetrically fixed to both sides of the rectangular hollow tube in two groups. The two sets of cross bars 7432 are joined in a unitary structure and pass through the rectangular hollow tube in the transverse direction, that is, the two cross bars 7432 fixed to both sides of the backrest lever 7431 are actually one. The plurality of cross bars 7432 cover cylindrical drums 7433 respectively Referring to FIG. 11, since the backrest 743 is biased by the torsion spring between the backrest 743 and the rear end of the connector 744, the backrest 743 can be turned rearwardly when the back of the simulators of rowing is applied to the backrest 743. The backrest 743 can be turned back from the A position to the B position, and when the back of the simulators of rowing does not force the backrest 743, the backrest 743 is reset by the torsion spring and returns from the B position to the A position.

A magnetic control water resistance rowing machine according to the present invention adopts a backrest 742 at the rear of the seat plate 741, the backrest 742 is hingedly connected to the rear end of the seat plate 741 by a torsion spring so that during the process of simulating of rowing it is possible to support the back of the simulators of rowing and greatly improve the use effect of the simulating of rowing. The cylindrical roller 7433 is separately provided on the plurality of cross bars 7432, and in the course of use, the roller 7433 can be rolled to form the effect of massaging on the back of the simulators of rowing, increasing the health effect of the product.

In summary, the magnetic control water resistance rowing machine are formed on the basis of the original magnetic control water resistance rowing machine, and the magnetron structure and the water resistance structure can be used to provide damping, and the magnetron structure is mainly used to realize the adjustment of the damping size, between the ribbon recycling plate set and the aluminum wheel water resistor set, you can use a belt drive, you can also use a chain drive or a gear for transmission. The cushion can have a backrest, it can also have no backrest, the effect of use a backrest is better than no backrest.

INDUSTRIAL UTILITY

The invention comprises a main rack, a ribbon, a ribbon recycling plate set, an aluminum wheel water resistance device set, a magnetic plate set and a seat cushion to form a magnetic control water resistance rowing machine, and the magnetron structure adopts an aluminum wheel and a magnetic plate, with the composition to achieve the regulation of damping size. The power generated by the belt is transferred to the aluminum wheel water resistance device set through the transmission mechanism, the transmission mechanism adopt preferred belt mechanism, it can be a chain mechanism. It is easy to realize in industry for the invention, and the main rack, the ribbon, the ribbon recycling plate set, the aluminum wheel water resistance set, the magnetic plate set and the seat cushion and the transmission mechanism and other components is also easy to process in the industry.

The foregoing is intended only as a preferred embodiment of the present invention, and therefore it is not intended that the scope of the invention be limited thereto, that is, the equivalents of modifications and modifications in accordance with the scope of the present invention and the specification are intended to cover the scope of the invention in the range.

The invention claimed is:

1. A magnetic control water resistance rowing machine, wherein comprising:

a main rack, a ribbon, a ribbon recycling plate set, an aluminum wheel water resistor set, a magnetic plate set, and a seat cushion, wherein:

the ribbon is connected to the ribbon recycling plate set, the ribbon recycling plate set is resetably disposed on the main rack to recycle the ribbon when the ribbon is loosened, the aluminum wheel water resistor set is disposed on the main rack, the aluminum wheel water resistor set comprises an aluminum wheel set and a water resistance device, the aluminum wheel set is drivably connected to the water resistance device, the ribbon recycling plate set is drivably connected to the aluminum wheel set, the ribbon recycling plate set is drivably connected to the aluminum wheel water resistor set;

the magnetic plate set is disposed on the main rack and is connected to the aluminum wheel water resistor set to achieve adjustment of a damping size of the aluminum wheel water resistor set, the main rack comprises a slide rail engagement, the seat cushion is slidably engaged with the slide rail engagement, the ribbon recycling plate set comprises a first belt turntable, the aluminum wheel set comprises a second belt turntable, and a belt is connected between the first belt turntable and the second belt turntable to drive the ribbon recycling plate set to rotate the aluminum wheel set through the belt.

2. The magnetic control water resistance rowing machine according to claim 1, wherein the ribbon recycling plate set is rotatably disposed on the main rack through a first wheel shaft.

3. The magnetic control water resistance rowing machine according to claim 2, wherein:

the aluminum wheel set further comprises an aluminum wheel and a second wheel shaft, the second belt turntable is fixed to the second wheel shaft, the aluminum wheel is fixed to the second wheel shaft, and both ends of the second wheel shaft are respectively rotatably disposed on the main rack by a flange set.

4. The magnetic control water resistance rowing machine according to claim 3, wherein:

the first wheel shaft and the second wheel shaft are respectively disposed along a length of the magnetic control water resistance rowing machine, and a position of the second wheel shaft is higher than a position of the first wheel shaft.

5. The magnetic control water resistance rowing machine according to claim 3, wherein:

the water resistance device comprises a built-in third wheel shaft, and the built-in third wheel shaft of the water resistance device is connected to the second wheel shaft by a rotary engagement so that rotation of the second wheel shaft drives the built-in third wheel shaft to rotate.

6. The magnetic control water resistance rowing machine according to claim 5, wherein the water resistance device is obliquely disposed on the main rack.

7. The magnetic control water resistance rowing machine according to claim 1, wherein:

the magnetic plate set comprises a pallet having a U-shaped cross section and a magnet disposed in the pallet by a positioning grid, a U-shaped opening defined by the U-shaped cross section is shaped according to an edge of an aluminum wheel of the aluminum wheel set;

an end of the pallet is rotatably disposed on the main rack, and the pallet is connected with a spinner or a servomotor by a cable.

8. The magnetic control water resistance rowing machine according to claim 1, wherein:

the main rack further comprises a front bottom pipe engagement, a rear bottom pipe engagement and a frame engagement, the frame engagement is connected to a front end of the slide rail engagement, the front bottom pipe engagement is fixed to a bottom of the frame engagement, the rear bottom pipe engagement is fixed to a rear end of the slide rail engagement, and the frame engagement has an inclined shape.

9. The magnetic control water resistance rowing machine according to claim 1, wherein:

the seat cushion comprises a seat plate, a chute disposed at a bottom of the seat plate and a backrest, the backrest is hingedly connected to a rear end of the seat plate, and the chute is slidably engaged with the slide rail engagement.

10. The magnetic control water resistance rowing machine according to claim 9, wherein:

a connecting member is further disposed between the seat plate and the chute, the backrest comprises a backrest bar and a plurality of cross bars, a bottom end of the backrest is resetably hinged at a rear end of the connecting member, the plurality of cross bars are respectively fixed on both sides of the backrest bar, and the plurality of cross bars respectively cover cylindrical drums.

11. A magnetic control water resistance rowing machine, comprising:

a main rack, a ribbon, a ribbon recycling plate set, an aluminum wheel water resistor set, a magnetic plate set, and a seat cushion, wherein:

the ribbon is connected to the ribbon recycling plate set, the ribbon recycling plate set is resetably disposed on the main rack to recycle the ribbon when the ribbon is loosened, the aluminum wheel water resistor set is disposed on the main rack, the aluminum wheel water resistor set comprises an aluminum wheel set and a water resistance device, the aluminum wheel set is drivably connected to the water resistance device, the ribbon recycling plate set is drivably connected to the aluminum wheel set, the ribbon recycling plate set is drivably connected to the aluminum wheel water resistor set, the magnetic plate set is disposed on the main rack and is connected to the aluminum wheel water resistor set to achieve adjustment of a damping size of the aluminum wheel water resistor set, the main rack comprises a slide rail engagement, the seat cushion is slidably engaged with the slide rail engagement, the ribbon recycling plate set comprises a first sprocket wheel, the aluminum wheel set comprises a second sprocket wheel, and a chain is connected between the first sprocket wheel and the second sprocket wheel to drive the ribbon recycling plate set to rotate the aluminum wheel set through the chain.

12. The magnetic control water resistance rowing machine according to claim 11, wherein the ribbon recycling plate set is rotatably disposed on the main rack through a first wheel shaft.

13. The magnetic control water resistance rowing machine according to claim 12, wherein:

the aluminum wheel set further comprises an aluminum wheel and a second wheel shaft, the second sprocket wheel is fixed to the second wheel shaft, the aluminum wheel is fixed to the second wheel shaft, and both ends of the second wheel shaft are respectively rotatably disposed on the main rack by a flange set.

14. The magnetic control water resistance rowing machine according to claim 13, wherein:

the first wheel shaft and the second wheel shaft are respectively disposed along a length of the magnetic control water resistance rowing machine, and a position of the second wheel shaft is higher than a position of the first wheel shaft.

15. The magnetic control water resistance rowing machine according to claim 13, wherein:

the water resistance device comprises a built-in third wheel shaft, and the built-in third wheel shaft of the water resistance device is connected to the second wheel shaft by a rotary engagement so that rotation of the second wheel shaft drives the built-in third wheel shaft to rotate.

16. The magnetic control water resistance rowing machine according to claim 15, wherein the water resistance device is obliquely disposed on the main rack.

17. A magnetic control water resistance rowing machine, comprising:

a main rack, a ribbon, a ribbon recycling plate set, an aluminum wheel water resistor set, a magnetic plate set, and a seat cushion, wherein:

the ribbon is connected to the ribbon recycling plate set, the ribbon recycling plate set is resetably disposed on the main rack to recycle the ribbon when the ribbon is loosened, the aluminum wheel water resistor set is disposed on the main rack, the aluminum wheel water resistor set comprises an aluminum wheel set and a water resistance device, the aluminum wheel set is drivably connected to the water resistance device, the ribbon recycling plate set is drivably connected to the aluminum wheel set, the ribbon recycling plate set is drivably connected to the aluminum wheel water resistor set, the magnetic plate set is disposed on the main rack and is connected to the aluminum wheel water resistor set to achieve adjustment of a damping size of the aluminum wheel water resistor set, the main rack comprises a slide rail engagement, the seat cushion is slidably engaged with the slide rail engagement, the magnetic plate set comprises a pallet having a U-shaped cross section and a magnet disposed in the pallet by a positioning grid, a U-shaped opening defined by the U-shaped cross section is shaped according to an edge of an aluminum wheel of the aluminum wheel set, an end of the pallet is rotatably disposed on the main rack, and the pallet is connected with a spinner or a servomotor by a cable.

18. The magnetic control water resistance rowing machine according to claim 17, wherein the ribbon recycling plate set is rotatably disposed on the main rack through a first wheel shaft.

* * * * *